US005157818A

United States Patent [19]

Voswinckel

[11] Patent Number: 5,157,818

[45] Date of Patent: Oct. 27, 1992

[54] METHOD AND APPARATUS FOR SIZING AND DRAWING A TRAVELING TEXTILE FILAMENT

[75] Inventor: Gerhard Voswinckel, Aachen, Fed. Rep. of Germany

[73] Assignee: Gebruder Sucker & Franz Muller GmbH & Co., Fed. Rep. of Germany

[21] Appl. No.: 698,537

[22] Filed: May 10, 1991

[30] Foreign Application Priority Data

May 18, 1990 [DE] Fed. Rep. of Germany ..... 4016045

[51] Int. Cl.[5] ..... C08G 63/78; D02J 1/22

[52] U.S. Cl. ..... 28/180; 28/178; 28/182; 28/245; 28/246

[58] Field of Search ..... 28/178, 179, 180, 182, 28/183, 245, 246

[56] References Cited

U.S. PATENT DOCUMENTS

| | | | |
|---|---|---|---|
| 2,611,172 | 9/1952 | Bolinger et al. | 28/180 |
| 2,976,600 | 3/1961 | Edgar | 28/179 |
| 2,992,626 | 7/1961 | Kabelitz | 28/179 X |
| 3,045,360 | 7/1962 | Alexeff et al. | 28/179 X |
| 3,046,437 | 10/1968 | Tew | 28/180 |
| 3,466,717 | 9/1969 | Kuroda | 28/180 |
| 4,025,993 | 5/1977 | Kuroda | 28/183 X |
| 4,112,668 | 9/1978 | Spiller | 28/246 X |
| 4,485,063 | 11/1984 | Good | 28/246 X |
| 4,858,287 | 8/1989 | Maurer et al. | 28/180 X |

FOREIGN PATENT DOCUMENTS

| | | |
|---|---|---|
| 0301266 | 1/1988 | European Pat. Off. . |
| 3602968 | 6/1987 | Fed. Rep. of Germany . |

*Primary Examiner*—Werner H. Schroeder
*Assistant Examiner*—Bibhu Mohanty
*Attorney, Agent, or Firm*—Shefte, Pinckney & Sawyer

[57] ABSTRACT

In sizing and drawing of one or more textile filaments, particularly a warp sheet of multiple filaments, by successively conveying the filaments through a sizing bath, a driven squeezing mechanism, a differentially driven spaced drying roller, and a warp beam or other filament winding mechanism, the filaments are heated to a temperature of approximately 100° C. and maintained in a predetermined moistened condition, e.g., by the application of saturated airborne water vapor, within the draw zone between the squeezing mechanism and the drying roller, in order to achieve a sufficiently elevated temperature for draw stretching of polyester filaments, particular POY and LOY filament, without premature drying and undesirable cracking of the sizing applied to the filaments.

14 Claims, 1 Drawing Sheet

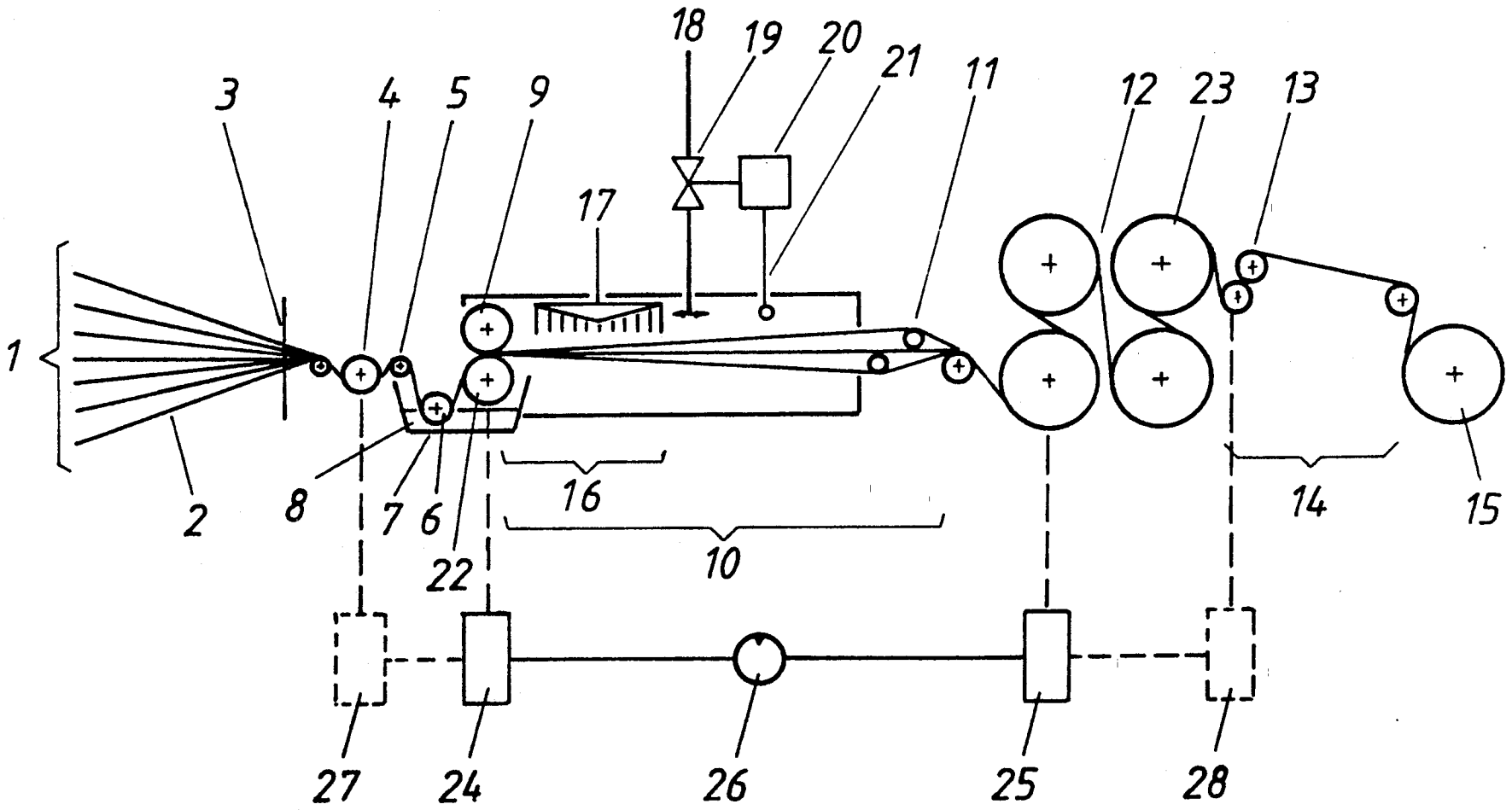
1
2
3
4
5
6
7
8
9
10
11
12
13
14
15
16
17
18
19
20
21
22
23
24
25
26
27
28

METHOD AND APPARATUS FOR SIZING AND DRAWING A TRAVELING TEXTILE FILAMENT

BACKGROUND OF THE INVENTION

The present invention relates generally to the sizing and drawing of synthetic textile filaments and, in particular, to such methods and apparatus wherein the filament is conveyed successively through a sizing bath, a driven filament squeezing mechanism or device, a driven drying roller spaced downstream from the squeezing mechanism to define a draw zone therebetween and driven at a differential relative speed to the squeezing mechanism for draw stretching of the filament while traveling through the draw zone, where the filament will be simultaneously pre-dried, and a winding machine or device for final take-up of the drawn filament.

West German Offenlegungsschrift DE-OS 36 02 968 A1 discloses a filament sizing and drawing system of the aforedescribed type whose preferred embodiment is adapted for simultaneous operation on a plurality of textile filaments traveling in side-by-side relation to one another in the form of a warp sheet. In the described apparatus and method, draw stretching of the multiple filaments is accomplished in the area between the squeezing mechanism and the succeeding drying cylinder or roller wherein the filaments remain wetted with sizing, which serves to assure a defined filament temperature during stretching and further eliminates the need for any additional machine units to accomplish drawing of the filament sheet. Within the draw and pre-drying zone, the individual filaments of the filament sheet exhibit a defined temperature, namely, the essentially constant dew point temperature which automatically develops in the pre-drying zone after the filaments leave the sizing bath, generally in the range of approximately 60° C.

As is known, in order for the draw stretching to which the filaments are subjected in the draw zone to be effective for increasing alignment and ordering of the molecular and crystalline structure of the filaments, the filaments being drawn must be at a temperature exceeding the glass transition temperature for the particular filamentary material Since polyamide filaments may be effectively drawn at temperatures in the range of the aforesaid dew point temperature typically prevailing in the filaments as they pass through the squeezing mechanism. the above-described known method and apparatus has proven satisfactory for drawing of polyamide filaments. However, on the other hand, this known method and apparatus is generally ineffective for drawing of other textile filaments, particularly partially oriented and low oriented polyester filaments, commonly referred to as POY and LOY filaments, since polyester filaments can only be effectively drawn at considerably higher temperatures in the range, for example, of 80° to 100° C. Depending upon the particular filamentary material, e.g., polyamide or polyester, and its initial state, e.g., POY or LOY, filaments may be drawn to a degree or ratio which may range, for example, between 1.3 and 3.2 times the starting length of the filament. Thus, it will be understood that such drawing of synthetic filaments involves a relatively significant permanent lengthening of the filament while at a temperature elevated above the filament's glass transition temperature, as opposed to a temporary, essentially elastic elongation of filaments occurring below the applicable transition temperature.

Within the framework of the method and apparatus disclosed in the aforesaid West German Offenlegungsschrift DE-0S 36 02 968 A1, it would be impractical and counterproductive to elevate the filament temperature in the area of the squeezing mechanism sufficiently to accommodate drawing of POY and LOY-type polyester yarns because the elevated temperature and the correspondingly lengthened processing time to which the filaments would be subjected to heating would cause the sizing to prematurely dry on the filaments and prevent the sizing from elongating to the same degree as the filaments, thereby causing a tendency of the dried sizing to crack. Moreover, since the known method and apparatus relies largely upon the essentially constant dew point temperature which naturally occurs in the filaments upon leaving the squeezing mechanism, this known method and apparatus would suggest that additional heating of the filaments should be avoided.

SUMMARY OF THE INVENTION

It is accordingly an object of the present invention to provide an improvement in known methods and apparatus of the aforedescribed type for sizing and drawing textile filaments which will achieve a temperature sufficient for the drawing of POY and LOY filaments, particularly polyester filaments and the like, while avoiding premature drying and resultant undesired cracking of the sizing applied to the filaments.

According to the present invention, this objective is achieved in sizing and drawing methods and apparatus of the type involving successive filament traveling through a sizing bath, a driven filament squeezing mechanism, a differentially driven drying roller spaced downstream from the squeezing mechanism to define a draw zone therebetween, and a winding mechanism, by maintaining the filament or filaments being processed in a predetermined moistened condition and at a predetermined temperature in the range of approximately 100° while traveling within the draw zone. For this purpose, the apparatus and method of the present invention is characterized by the provision of a suitable means for wetting or otherwise moistening the filaments within the draw zone following the squeezing mechanism. It has been discovered that, if the filaments are maintained sufficiently moistened, particularly within an initial portion of the draw zone which traditionally serves a predrying function, it is possible to heat the filaments to a sufficient temperature enabling drawing of synthetic filaments, such as polyester filaments, which typically are difficult to draw, without premature and disadvantageous drying of sizing on the filaments. In effect, the initiation of the filament drying process is thereby delayed according to the present invention. However, the overall length or extent of the drying region of the sizing and drawing system need not be increased because the more elevated filament temperature enables the filaments to dry more quickly after leaving the draw zone.

Thus, in accordance with the present invention, the freshly sized filament or filaments are maintained at or heated to approximately 100° C., preferably in the range of between approximately 90° C. and approximately 100° C., without any appreciable attendant drying of the filament or filaments until after passing through the entire draw zone and having been completely drawn to the desired degree. In some cases, heating of the filaments by means of the sizing bath may suffice for achieving the desired heating of the filaments if the desired temperature is maintained without drying of the filaments over the entire draw zone. However, it is also contemplated that additional heating of the filaments may be provided, preferably in the area of the squeezing mechanism or immediately thereafter in the draw zone. In either case, care must taken to avoid undesirable drying of the yarn, particularly on its surface, while traveling through the draw zone.

In embodiments of the invention wherein additional heating of the filaments is provided, high frequency heat energy may be applied to the filaments to develop heat within the filament body or, alternatively, heat may be applied exteriorly to the traveling filaments by contact, convection, or radiant heating means.

In embodiments employing exterior application of heat to the filaments and embodiments utilizing and maintaining the heat applied to the filaments within the sizing bath, the filaments are preferably maintained in a desired moistened condition by means of saturating the ambient air in the draw zone with water vapor. It is also contemplated within the scope of the present invention that supersaturated air may occupy the draw zone. Thus, the particular adjustment of the degree of ambient air saturation in the draw zone is not critical under the invention. The saturation of the draw zone air with water vapor enables the filaments to still be heated within the draw zone not only to the level of the dew point temperature of approximately 60° C. but to more elevated temperatures in the range of approximately 90° to 100° C. for filament drawing at the full transport speed of the sizing system, while at the same time preventing the sizing applied to the filaments from being prematurely dried and becoming damaged by the drawing operation.

In embodiments wherein the filaments are to be heated with high frequency heat energy, it is desirable that the moisture content of the ambient air in the draw zone be only sufficient to prevent the generation of electrical sparking or flashing. However, since the body of the filaments is heated essentially interiorly, little risk exists of premature drying of the sizing on the filaments, so that the sizing will generally tend to remain moist for a sufficient period of time to accommodate normal drawing without the presence of water vapor saturated air. Preferably, the heating speed should considerably exceed the drying speed since, as will be understood, the heating time naturally affects the retention of moisture by the sizing.

In sum, the present invention thus makes possible the achievement of relatively higher temperatures and relatively shorter dwell times in the treatment zones of a textile sizing and drawing apparatus and method, including the application of additional heat to the filaments if necessary, without premature drying of the sizing on the filaments, by means of maintaining a predetermined moisture content in the filaments, by means of the application of saturated water vapor laden air if necessary.

In the preferred embodiment of the present apparatus and method, a plurality of filaments in side-by-side relation in the form of a warp sheet are simultaneously sized and drawn. Initially, the multiple filaments are drawn in sheet form from a creel or a warp beam and the full width of the filament sheet is passed through a trough containing a sizing bath, which is effective to elevate the filaments to a temperature in the range of approximately 70° to 95° C. Upon removal from the sizing bath, the filament sheet is delivered to a squeezing mechanism, preferably in the form of a pair of driven nip rolls which serve a predrying function to extract by squeezing a portion of the size taken by the filaments in the sizing bath, thereby leaving the filaments in a predetermined wetted condition. The filaments travel from the squeezing rollers a predetermined distance comprising the draw zone to a downstream drying roller, such as a cylinder dryer, driven at a greater surface speed than the squeezing rollers to apply a stretch drawing to the filaments within the draw zone. The drying roller serves to finally dry the sizing on the thusly elongated filaments. Next, the filaments are directed to a warp beam for winding thereon in side-by-side relation. In typical embodiments, the drying roller may apply a temperature in the range of approximately 130° C. to approximately 160° C. to the filament and, at the same time, the tension in the filaments may be relieved to permit them to relax.

When the filament temperature achieved by the sizing bath is sufficient to accommodate drawing of the filaments, e.g., with polyamide filaments, the filaments are drawn in the draw zone in the presence of ambient air saturated with water vapor, without the application of additional heat. Otherwise, additional heat may be applied to the filaments at the squeezing rollers or shortly thereafter to enable drawing of the filament to occur in the draw zone, again in the presence of water vapor-saturated air except, as mentioned, when the additional heating is by means of application of high frequency heat energy.

In one embodiment, one of the squeeze rollers may be utilized for applying additional heat to the filaments, in which case, the draw zone begins generally at the nip point at which the filaments exit the squeezing rollers. On the other hand, in embodiments wherein other heating means are provided in the area between the squeezing rollers and the drying roller, the starting point of the draw zone is located intermediate the squeezing rollers and the drying roller in correspondence to the location of the additional heating means. By way of example, additional heated rollers may be provided downstream of the squeezing mechanism for heating by contact with the traveling filaments after they have exited the squeezing mechanism.

Furthermore, it is considered advantageous in embodiments utilizing radiant, high-frequency heat energy, or heated water vapor heating of the filament sheet to provide a stretching pin or rod positioned downstream of the squeezing mechanism in surface contact with the traveling filaments to provide a defined starting point of the draw zone. If necessary or desirable, the stretching pin or rod may be located upstream of the additional heating means. It is also possible to provide other filament-engaging rods shortly in advance of the drying roller in the sizing and drawing system. In any case (except when utilizing high frequency heat energy), the ambient air within the draw zone should be saturated with water vapor beginning at the starting point of the draw zone, i.e., the point at which the filament sheet reaches it glass transition or flow temperature to facilitate permanent elongation.

The moisture content in the ambient air within the draw zone may be automatically maintained at the desired saturation value by a suitable control system. Optionally, water vapor content within the draw zone may be controlled by a moisture sensing device which reacts to saturation and supersaturation of the ambient air, a regulator operated by the moisture sensing device, a vapor or steam valve operated by the regulator, and a vapor injection tube supplied by the valve and communicating with the draw zone.

In addition to the advantageous results achieved by the present invention in sizing and drawing polyester and other yarns which require more elevated draw temperatures, the present invention also provides unexpected advantages in the sizing and drawing of filaments which do not require relatively elevated temperatures in the range of approximately 100° C. for drawing, e.g., polyamide filaments. More specifically, use of the method and apparatus of the present invention for drawing polyamide and other yarns capable of being drawn at lower temperatures achieves a more rapid heating of the filaments and higher degrees of elongation, e.g., considerably greater than 1.6 times, so that considerably higher filament traveling speeds and, in turn, higher production rates can be realized.

BRIEF DESCRIPTION OF THE DRAWING

The drawing FIGURE is a schematic diagram of a textile processing system for sizing and drawing multiple textile filaments in the form of a warp sheet according to the preferred embodiment of the present method and apparatus.

DESCRIPTION OF THE PREFERRED EMBODIMENT

Referring now to the accompanying drawing, a preferred embodiment of processing system for sizing and drawing a warp sheet of textile filaments is shown. Plural individual filaments 2, especially of polyester yarn. are delivered in side-by-side relation in the form of a warp sheet, collectively identified by reference numeral 1, from a creel (not shown) supporting multiple individual filament packages. The warp filaments 2 are directed through a warp reed 3 and therefrom in peripheral contact with a rotatable delivery roller 4 and a rotatable infeed roller 5 into a sizing trough 7 containing a quantity of liquid sizing bath 8 through which the full width of the warp filament sheet 1 passes beneath a rotatable immersion roller 6 in peripheral contact therewith. The warp filament sheet 1 travels upwardly out of the sizing bath 8 and between a pair of peripherally contacting nip rollers forming a filament squeezing mechanism 9 disposed above the exit side of the sizing trough 7. The squeezing mechanism 9 serves to extract a proportion of the liquid sizing from the traveling filaments 1 and to return the extracted sizing into the trough 7, leaving the filaments with a predetermined sizing content. After exiting the squeezing mechanism 9, the filament sheet 1 travels horizontally through a draw zone 10 to a rotatable cylinder dryer, designated in its entirety at 12, from which the filament sheet 1 is delivered peripherally about a series of drawoff rolls 13 to a warp beam 15 for winding thereabout.

The filament sheet 1 is heated as it travels through the draw zone 10, preferably within an entrance region 16 thereof, by means of an auxiliary heater 17, e.g., a radiant heating device, which is adapted to elevate the filament temperature to approximately 100° C., preferably in the range of about 90° to 100° C. At the same time, the ambient air within the entrance region 16 and along the remaining length and width of the draw zone 10 is saturated with water vapor. For example, the draw zone 10 may be substantially enclosed by a housing into which steam or water vapor is injected through a vapor injection tube 18 supplied by a valve 19 the opening and closing of which is operated by a regulator 20 controlled by a moisture sensing device 21 disposed within the draw zone housing.

Alternatively, additional heating of the filament sheet 1 beyond the temperature achieved by passage through the sizing bath 8 may be accomplished by the application of high frequency heat energy within the draw zone housing or by the injection of heated water vapor through the injection tube 18. In the latter instance, no additional heating device or apparatus 17 would be required, the heated water vapor being sufficient alone to further elevate the temperature of the filaments 2. Likewise, an additional heating device or apparatus 17 can be eliminated from the entrance region 16 by incorporating heating means in the squeezing mechanism 9. For example, the lowermost roller 22 of the squeezing rollers may be heated interiorly or otherwise incorporate appropriate means for thermal heating for application of heat to the traveling filaments as they pass through the squeezing mechanism 9. In this embodiment, therefore, the squeezing mechanism 9 forms a part of the entrance region 16 of the draw zone 10.

After draw stretching of the filament sheet 1 in the draw zone 10 and, as applicable, additional heating of the filament sheet 1, the filament sheet 1 passes over rods 11 which can be arranged to subdivide the filament sheet 1, as shown, and then travels peripherally about a cylinder drying apparatus 12 consisting of a plurality of individual heated cylinders 23 about which the filament sheet 1 travels in a sinuous path. Preferably, the filaments are heated by the cylinder drying apparatus 12 to a temperature in the range of approximately 120° C. to dry the filaments and at the same time heat set them in their drawn elongated stated, after which the filaments may be permitted to relax.

In the specific preferred embodiment illustrated, the delivery roller arrangement 4 and/or the squeezing mechanism 9 serve a braking function on the filaments 2 tending to retard their travel through the draw zone 10 and, in particular within the entrance zone 16, in opposition to the counterforce exerted on the filaments 2 by the driven cylinder drying apparatus 12. More particularly the nip rolls of the squeezing apparatus 9 are positively driven by a drive motor or other drive mechanism 24 and, similarly, the individual drying cylinders 23 of the cylinder drying apparatus 12 are driven positively by a drive motor or other drive mechanism 25 at a sufficiently greater peripheral surface speed than the surface speed of the squeezing rollers of the squeezing mechanism 9 to produce a corresponding desired draw ratio. Thus, the desired degree of draw stretching of the filament sheet 1 may be smoothly adjusted by means of a control device 26 operatively connected to the drives 24, 25 for adjustably controlling their respective driving speeds. In this manner, the surface speed of the squeezing rollers 9 delivers the warp filament sheet 1 at a relatively lower traveling speed corresponding to the traveling speed of the filaments during the application of sizing within the sizing bath 8, whereas the driven surface speed of the drying cylinders 23 is set to correspond essentially identically to the winding take-up speed of the warp beam 15.

It is additionally possible to utilize the delivery roller 4 and the take-up rollers 13 either alone or in addition to the squeezing mechanism 9 and the cylinder drying apparatus 12 for drawing of the filament sheet 1. In such cases, the delivery and take-up rollers 4, 13 are driven via respective drive motors or drive mechanisms 27, 28 also or alternatively regulated by the control device 26. The drive of the delivery roller 4 may therefore be arranged in combination or operative association with the drive for the squeezing mechanism 9, while similarly the drives for the cylinder drying apparatus 12 and the take-up rollers 13 are combined or operatively associated. It may also be advantageous to arrange the delivery roller 4 and the squeezing mechanism 9 as well as the cylinder drying apparatus 12 and the take-up rollers 13 in a predetermined spatial relationship to one another to further optimize drawing of the filaments.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonable suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of sizing and drawing a textile filament comprising the steps of conveying the filament successively through a sizing bath, a driven filament squeezing means, a driven drying roller at a downstream spacing from said squeezing means defining a draw zone therebetwen, and a winding means, while controlling the relative driven speeds of said squeezing means and said drying roller for drawing of the filament in said draw zone, wherein the improvement comprises maintaining the filament in a predetermined moistened condition and at a predetermined drawing temperature in the range of approximately 100° C., without drying of the filament and without removal of sizing therefrom, while traveling within said draw zone.

2. A method of sizing and drawing a textile filament according to claim 1 and further comprising heating the filament downstream of said sizing bath.

3. A method of sizing and drawing, a textile filament according to claim 2 and further comprising heating the filament at said squeezing means.

4. A method of sizing and drawing a textile filament according to claim 2 and further comprising heating the filament within said draw zone.

5. A method of sizing and drawing a textile filament according to claim 1 and further comprising developing a predetermined airborne water vapor content in said draw zone.

6. A method of sizing and drawing a textile filament according to claim 1 and further comprising heating the filament by applying high frequency heat energy thereto.

7. An apparatus for sizing and drawing a traveling filament comprising, in succession, a sizing bath, a driven filament squeezing means, a driven drying roller at a downstream spacing from said squeezing means defining a draw zone therebetween, and a winding means, and means for controlling the relative driven speeds of said squeezing means and said drying roller for drawing of the filament in said draw zone, wherein the improvement comprises means for maintaining the filament in a predetermined moistened condition and at a predetermined temperature in the range of approximately 100° C., without drying of the filament and without removal of sizing therefrom, while traveling within said draw zone.

8. An apparatus for sizing and drawing a traveling filament according to claim 7 and further comprising means for heating the filament downstream of said sizing bath.

9. An apparatus for sizing and drawing, a traveling filament according to claim 8 and wherein said squeezing means includes said heating means.

10. An apparatus for sizing and drawing a traveling filament according to claim 8 and wherein said heating means comprises a radiant heating means disposed in said draw zone.

11. An apparatus for sizing and drawing a traveling filament according to claim 8 and wherein said heating means comprises means for generating high frequency heat energy.

12. An apparatus for sizing and drawing a traveling filament according to claim 8 and wherein said heating means comprises means for developing a predetermined airborne water vapor content in said draw zone.

13. An apparatus for sizing and drawing a traveling filament according to claim 7 and wherein said means for maintaining the filament in a predetermined moistened condition comprises means for maintaining a predetermined airborne water vapor content in said draw zone.

14. An apparatus for sizing and drawing a traveling filament according to claim 13 and wherein said water vapor maintaining means comprises means for measuring water vapor content in said draw zone and means for variable delivery of water vapor into said draw zone.

* * * * *